US009209546B1

(12) United States Patent
Gibboney, Jr.

(10) Patent No.: US 9,209,546 B1
(45) Date of Patent: Dec. 8, 2015

(54) MECHANICAL AND ELECTRICAL CONNECTOR FOR ARTIFICIAL HOLIDAY TREE POLES

(71) Applicant: Central Garden and Pet Company, Walnut Creek, CA (US)

(72) Inventor: James W. Gibboney, Jr., Conyers, GA (US)

(73) Assignee: Central Garden and Pet Company, Walnut Creek, CA (US)

( * ) Notice: Subject to any disclaimer, the term of this patent is extended or adjusted under 35 U.S.C. 154(b) by 0 days.

(21) Appl. No.: 14/734,025

(22) Filed: Jun. 9, 2015

Related U.S. Application Data

(60) Provisional application No. 62/117,134, filed on Feb. 17, 2015.

(51) Int. Cl.

| | |
|---|---|
| ***H01R 13/64*** | (2006.01) |
| ***H01R 13/17*** | (2006.01) |
| ***A47G 33/06*** | (2006.01) |
| ***H01R 13/50*** | (2006.01) |

(52) U.S. Cl.
CPC ..... *H01R 13/17* (2013.01); *A47G 33/06* (2013.01); *H01R 13/50* (2013.01)

(58) Field of Classification Search
CPC .... H01R 13/631; H01R 13/629; A47G 33/06; F21S 4/001
USPC ..... 439/374, 376, 362; 362/568, 249.19, 362/659, 654
See application file for complete search history.

(56) References Cited

U.S. PATENT DOCUMENTS

| | | | | |
|---|---|---|---|---|
| 3,617,732 | A | 11/1971 | Fisher | |
| 3,985,924 | A | 10/1976 | Pritza | |
| 4,072,857 | A | 2/1978 | DeVicaris | |
| 5,550,720 | A | 8/1996 | Carroll | |
| 6,030,670 | A | 2/2000 | Chang | |
| 8,053,042 | B1 * | 11/2011 | Loomis | A47G 33/06 362/123 |
| 8,298,633 | B1 * | 10/2012 | Chen | A47G 33/06 248/512 |
| 8,454,186 | B2 * | 6/2013 | Chen | F21S 4/001 362/122 |
| 8,454,187 | B2 * | 6/2013 | Chen | 362/122 |
| 8,753,152 | B1 | 6/2014 | Tsai | |
| 8,870,404 | B1 | 10/2014 | Chen | |
| 8,876,321 | B2 | 11/2014 | Chen | |

(Continued)

FOREIGN PATENT DOCUMENTS

| | | |
|---|---|---|
| DE | 297 16374 U1 | 2/1998 |
| DE | 102 35 081 A1 | 2/2004 |
| WO | WO 96/26661 | 9/1996 |

*Primary Examiner* — Abdullah Riyami
*Assistant Examiner* — Thang Nguyen
(74) *Attorney, Agent, or Firm* — Michael A. Mann; Nexsen Pruet, LLC

(57) ABSTRACT

A locking mechanical and electrical connector for joining two sections of an artificial holiday tree includes an upper and a lower part that thread to a joined configuration from a separated configuration and locked in the joined position by a ball detent. Once completely joined, electrical contacts carried by the upper part are in electrical contact with electrical contacts carried by the lower part. The electrical wiring of the upper and lower parts is managed using harnesses and kept electrically separated from the two sections of the artificial tree. In joining of tree tubing sections, the weight of the upper section helps drive the rotation of the upper part with respect to the lower part, assisted by the low friction design of the threaded connection and the ball contact between the upper part electrical contacts and the interface surface of the lower part.

12 Claims, 11 Drawing Sheets

(56) References Cited

U.S. PATENT DOCUMENTS

| | | | | |
|---|---|---|---|---|
| 8,936,379 | B1 * | 1/2015 | Chen | F21S 4/001 362/123 |
| 8,956,183 | B2 | 2/2015 | Tsai | |
| 8,974,072 | B2 | 3/2015 | Chen | |
| 9,044,056 | B2 | 6/2015 | Chen | |
| 2005/0168973 | A1 | 8/2005 | Chuang | |
| 2005/0180163 | A1 * | 8/2005 | Huang | A47G 33/06 362/568 |
| 2006/0164834 | A1 | 7/2006 | Kao | |
| 2014/0049168 | A1 | 2/2014 | Chen | |
| 2014/0179159 | A1 | 6/2014 | Tsai | |
| 2014/0287618 | A1 | 9/2014 | Chen | |
| 2014/0334134 | A1 | 11/2014 | Loomis | |
| 2014/0349517 | A1 | 11/2014 | Tsai | |
| 2015/0029703 | A1 | 1/2015 | Chen | |
| 2015/0070878 | A1 | 3/2015 | Yu | |
| 2015/0078000 | A1 | 3/2015 | Chen | |

* cited by examiner

MECHANICAL AND ELECTRICAL CONNECTOR FOR ARTIFICIAL HOLIDAY TREE POLES

BACKGROUND

Each year, sales of artificial holiday trees increase, as more consumers come to see them as more convenient or a better choice for environmental sustainability. Having an artificial tree avoids the need to shop for a live tree every year and the associated cost of a fresh tree. Furthermore, artificial trees need no water to keep them green, and they generate less mess from dry needles.

The effort to buy and set up a live tree every year is a chore. The percentage of consumers who prefer artificial trees compared to live trees is increasing as the percentage of the population over 50 increases. Artificial Christmas trees are easier to assemble and disassemble, especially as many artificial Christmas trees can be purchased with built-in incandescent or LED lighting, which does not have to be removed and rolled up. Also, having an artificial tree means that there is no live tree to cut down or dead tree to dispose of.

Artificial holiday trees are usually made in sections so the trees can be taken apart for ease of storage. The cores of the artificial Christmas trees are typically made of sections of steel tubing. Each tube section has two ends: one male end and one female end, so one end of the next section can be easily inserted into the previous section to assemble the tree.

Each section must also be connected electrically to the next section. Power plugs on the lower end of a next section have to be mated to the correct plugs on the upper end of a previous section in order for all lights on the tree to work properly. This is especially important for trees that have special lighting effects. Assembling artificial tree sections often poses a challenge for consumers.

In most artificial Christmas trees, electrical wires run through the center of each tube section. As sections are joined, internal electrical connectors are aligned and connected automatically to simplify the assembly process. However, in order to align the connections, large manufacturing tolerances are provided so mating contacts do not jam, bend, short out, or break. Unfortunately, large tolerances can cause arcing when the artificial Christmas tree is moved, including movement caused when decorating the tree with ornaments, extra lights, tinsel, etc. Decorating often requires bending and spreading the limbs of each section in shaping the tree to look natural, in stretching and fluffing limbs that were flattened in the course of packaging or shipping the tree, and in adjusting the limb tips to hold special decorative ornaments. While decorating and shaping the tree, it is not unusual to see the tree section lights to flash on and off. This flashing occurs due to poor electrical design that fails to compensate for this movement.

In manufacturing, the wire harness of the core wire system requires considerable time and labor to assemble and then to install from the proximal end of the metal tube to the distal end, all the while extracting wires from the wire harness through holes in the tube for supplying power to the limb sections for the lights they carry. This is a difficult and arduous task, and takes at least as much time as it does to wrap limbs with lights. There is also the complicating factor of assuring that no wire insulation is cut or scraped during the process of assembly. However careful the worker is, there is always the possibility that a wire with a break in its insulation could short against the steel interior of the metal tube section, and thereby electrifying the entire tree, a very dangerous situation.

Still, another problem of prior art artificial trees is the manner in which the tube sections are joined. Essentially, one tube section slides into or over the next tube section. As one tube seats with the next, the two sections make electrical contact. The contacting terminals are located in the center of that tube section.

Prior art tube mating assemblies fit tightly to prevent arcing of the electrical contacts. The extruded tubing is passed through a hydraulic die system to flare one end and compress the other. The outer diameter of the compressed end of one tube section fits into the flared end of the next tube section. Depending on the source of the tubing, however, some sections might fit loosely and other sections, very tightly. After a few years of use, tube sections either become too loose or, if they are tight to begin with, the flared end would scrape the paint off the metal on the compressed end. Rust would then begin to accumulate, resulting in "rust-welding" of the sections. Accordingly, tube sections become either far too loose or far too difficult to separate, especially in the case of taller artificial trees.

In the case of loosely fitting tree tube sections, moving the assembled and decorated tree would cause the sections to separate, often resulting in broken ornaments. Even bending and shaping the steel "limbs" to make the tree appear more natural could cause sections to separate as well, particularly if the limbs are bent upwards.

SUMMARY OF THE DISCLOSURE

A mechanical-electrical connector connects two sections of a multi-section, lighted, artificial holiday tree both mechanically and electrically. Each section of the multi-section tree has an upper part with a passage formed therethrough and a wiring chamber with at least one electrical contact. Each of the sections also has a lower part that can be inserted into the upper part of another section and be secured to it. The lower part also has a wiring chamber that electrically carries at least one electrical contact. Both the upper and lower parts' wiring chambers are electrically isolated from the passage in the section.

An aspect of the disclosure is that the upper part and the lower part are both joinable and separable by rotating the upper part with respect to the lower part through a small angle between a joined position and a separated position. Furthermore, when the upper part and the lower part are joined, the electrical contacts of the upper part and those of the lower part are brought into electrical contact with each other, and, when the upper part and the lower part are rotated from the joined configuration, the electrical contacts are broken.

It is an aspect of the disclosure that the interior of the wall of the passage of the upper part carries threads that join to the threads on the exterior of the wall, of the lower part. It is a further aspect of the disclosure that the interior threads have a triangular cross-section and the exterior threads have a trapezoidal cross-section to facilitate sliding of the upper part with respect to the lower part so that the weight of an upper part and its tube section will provide most of the force need for rotating the upper part with respect to the lower part.

It is another aspect of the disclosure that the electrical contacts carried by the upper part are pins loaded by compression springs and the electrical contacts carried by the lower part are stationary, so that, when the upper part is rotated sufficiently with respect to the lower part, the compression springs of the upper part urge the pins into electrical connection against their respective electrical contacts carried by the lower part.

Still another aspect of the disclosure is that each of the wires of each part have an identical terminal electrically connectable to one of the electrical contacts.

Another aspect of the disclosure is that the upper part has a bottom and the lower part has an top that meet, when the upper part and the lower part are rotated to the joined position from the separated position, and that a stop on the top of the lower part prevents over-rotation of the upper part with respect to the lower part.

A particular aspect of the disclosure is that the top of the lower part has a recess and the upper part carries a ball detent pin, and when the upper part has been rotated to the joined position, the ball detent seats in the recess to help hold the two sections in alignment and in the electrical contacts in registration with each other.

Still another aspect of the disclosure is that the interface surface of the lower part has a ramp, and wherein the electrical contacts of the upper part are spring loadable pins, so when the upper part is rotated with respect to the lower part, the pins ride up the ramp thereby loading their respective compression springs. When the pins reach the electrical contacts on the lower part, and the spring detent pin seats in the recess on the lower part, the pins of the upper part are held firmly against the electrical contacts of the lower part.

DETAILED DESCRIPTION OF ASPECTS OF THE DISCLOSURE

Figure 1:
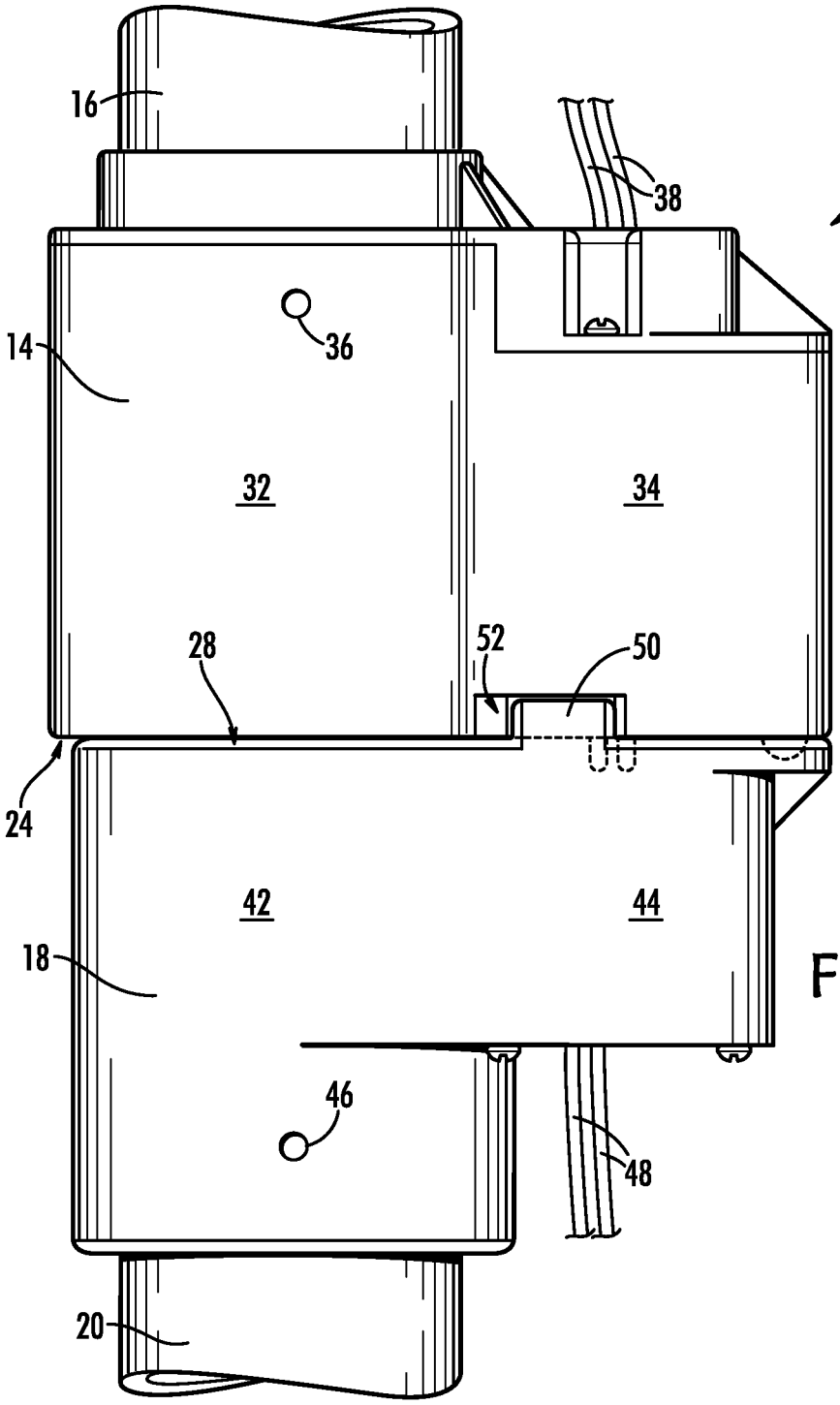
FIG. 1 shows a right side view of the upper and lower parts assembled, according to an aspect of the disclosure.

Artificial holiday trees are formed using hollow metal tube sections as a substitute for the trunk of an evergreen. For convenience in shipping, sections of metal poles are supplied to the consumer that, when assembled, form the trunk of a tree having a preselected height. Rather than have wiring inside the poles as in the prior art, an aspect of the disclosure is to have the wiring outside the poles running between the two parts of a two-part connector that also physically joins tube sections together. The ends of the tube sections are not joined directly, as in the prior art. FIG. 1 illustrates a right side view of connector 10 with upper tube section 16 extending upward from connector 10 and lower tube section 20 extending downward from connector 10.

Figure 2:
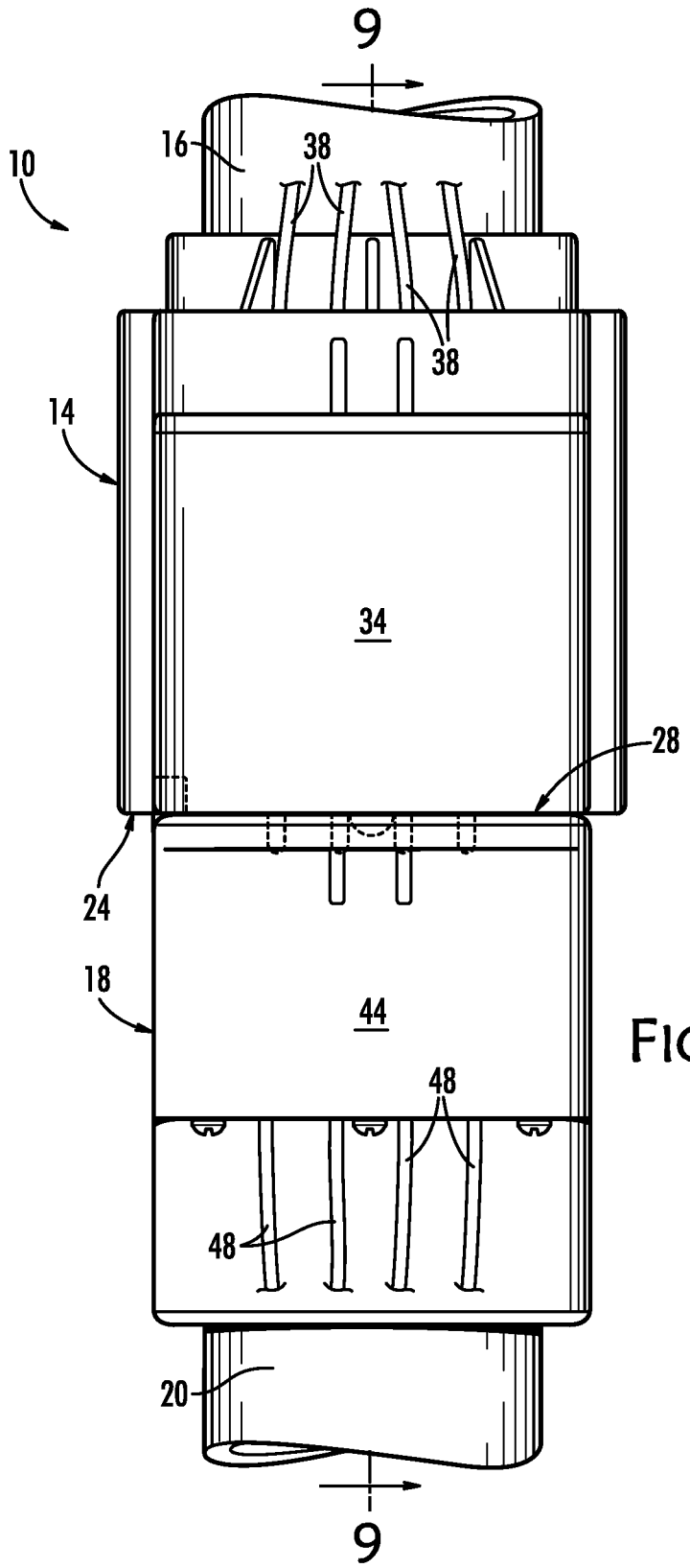
FIG. 2 is an end view of the assembled upper and lower parts, according to an aspect of the disclosure.
Figure 3:
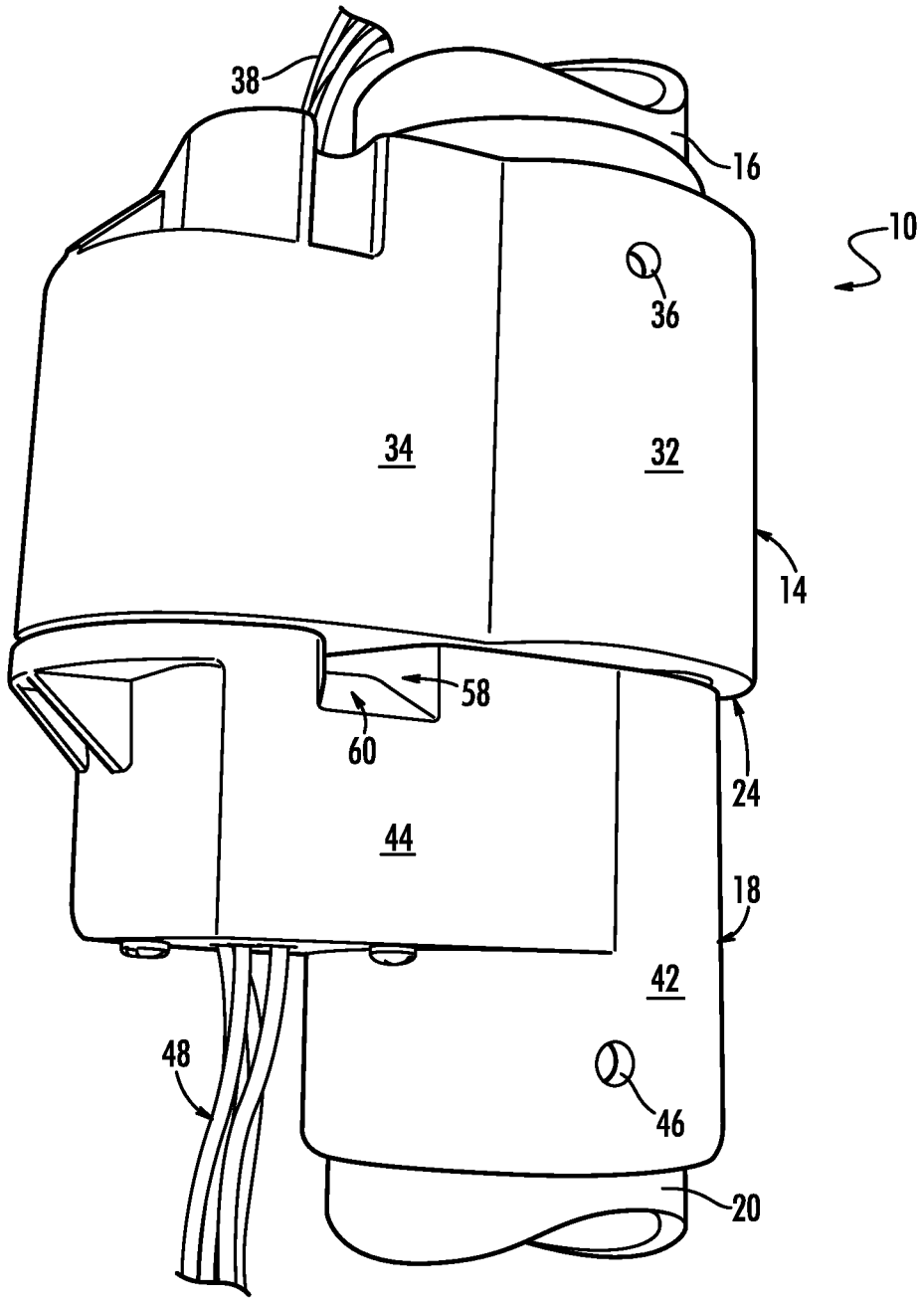
FIG. 3 is a left side perspective view of the upper and lower parts assembled, according to an aspect of the disclosure.

Referring now to FIG. 1-13, connector 10 shown has an upper part 14 that is attached to the bottom of upper tube section 16, and a lower part 18 that is attached to the top of lower tube section 20. Upper and lower parts 14, 18 are shown joined together in FIGS. 1-3 and 9, shown in the process of being separated in FIGS. 4 and 5, and separated in FIGS. 6-8. FIG. 1 illustrates an exterior right side view of connector 10; FIG. 2 illustrates a front end view of connector 10; FIG. 3 illustrates a perspective, left side view of connector 10.

Upper and lower tube sections 16, 20, are simply tubes, which may be made of metal, and painted or powder-metal coated, and will serve as surrogates for the "trunk" of an artificial tree (not shown).

As used herein the terms up, upper, down, and lower are used in relation to the orientation of an artificial holiday tree in an upright or standing position when assembled; that is, up is a direction away from the floor and down is a direction toward the floor, upper refers to something farther away from the floor and lower refers to something that is closer to the floor, when those things are in the orientation they are intended to be when assembled.

Upper tube section 16 and upper part 14 will be connected as described herein to lower tube section 20 and lower part 18, so upper tube section 16 will be above lower tube section 20 with respect to the floor when the artificial tree is standing and upper part 14 and lower part 18 will be joined and locked together to hold upper and lower tube sections 16, 20 in their proper orientation for use as an artificial tree. Upper and lower parts 14, 18, are made primarily of plastic but will include electrically conductive parts, and are formed and dimensioned to receive and be secured to upper and lower tubes 16, 20, respectively. When upper part 14 and lower part 18 are separated, such as when storing a holiday tree after a holiday season ends, they would normally remain with upper tube section 16 and lower tube section 20, respectively.

Both the bottom 24 of upper part 14 and the bottom of upper tube section 16 inside upper part 14 are co-terminus, as are the top 28 of lower part 18 and the top of lower tube section 20 inside lower part 18, however, bottom 24 of upper part 14 and top 28 of lower part 18 will be in full engagement with each other and serve as non-abrasive bearing surfaces when connector 10 is coupled. Accordingly, when the upper tube section 16 is attached to the lower tube section 20 via upper and lower parts 14, 18, respectively, neither tube section 16, 20, will be scratched by the other and therefore not be subject to the rust-welding issue of the prior art tree poles.

Tube side 32 of upper part 14 and tube side 42 of lower part 18 have passages 54, 56, respectively formed therethrough, dimensioned for receipt of upper tube section 16 and lower tube section 20. Hole 36 in upper part 14 and hole 46 in lower part 18 are through holes that may receive a screw or bolt crossing the full diameter of passages 54 and 56, respectively, for better security in holding first and second tube sections 16, 20, in place within tube sides 32, 42.

Also, in the prior art, each tube must be worked to compress one end and flare the opposite end. In the presently disclosed connector, however, while the ends of the tubes need to be inserted into an upper and a lower part 14, 18, of connector 10, the need for compressing and flaring steps is avoided. Furthermore, the cost for the specialized machinery to accomplish tube compressing and flaring is also avoided.

As best seen in FIG. 1, upper part 14 has an electrical side 34 that carries electrical wires 38. Similarly, lower part 18 has a corresponding electrical side 44 that also carries electrical wires 48. The interiors of electrical chambers 34, 44, will be described in more detail below.

As seen in FIG. 1 connector 10 has a stop 50 on lower part 18 that prevents over-rotation of upper part 14 with respect to lower part 18 and about a vertical axis through tube sides 32, 42. Stop 50 is received in a small recess 52 formed in electrical side 34 of upper part 14.

From FIG. 2, which shows an end view of upper and lower parts 14, 18, one can see four electrical wires 38 leaving upper part 14 and four wires 48 entering lower part 18. As lower part 18 is positioned nearer to the bottom of the holiday tree, electricity will be traveling from a source such as a wall socket to the tree and passing through a lowermost connector 10 to the next lowest connector 10 and so on up the tree, first into a lower part 18 and then out of an upper part 14 coupled to the lower part 18, and from the upper part of a lower connector to the lower part of an upper connector 10 above it, and so on to the top of the tree.

FIG. 3 shows connector 10 from the left side and in perspective. The left side of connector 10 is mostly symmetric with right side except that there is no stop 50 on lower part 18 and no recess 52 on upper part 14. There is, however, a recess 58 formed in lower part to define a ramp 60 on lower part 18 for a purpose to be described presently.

Figure 4:
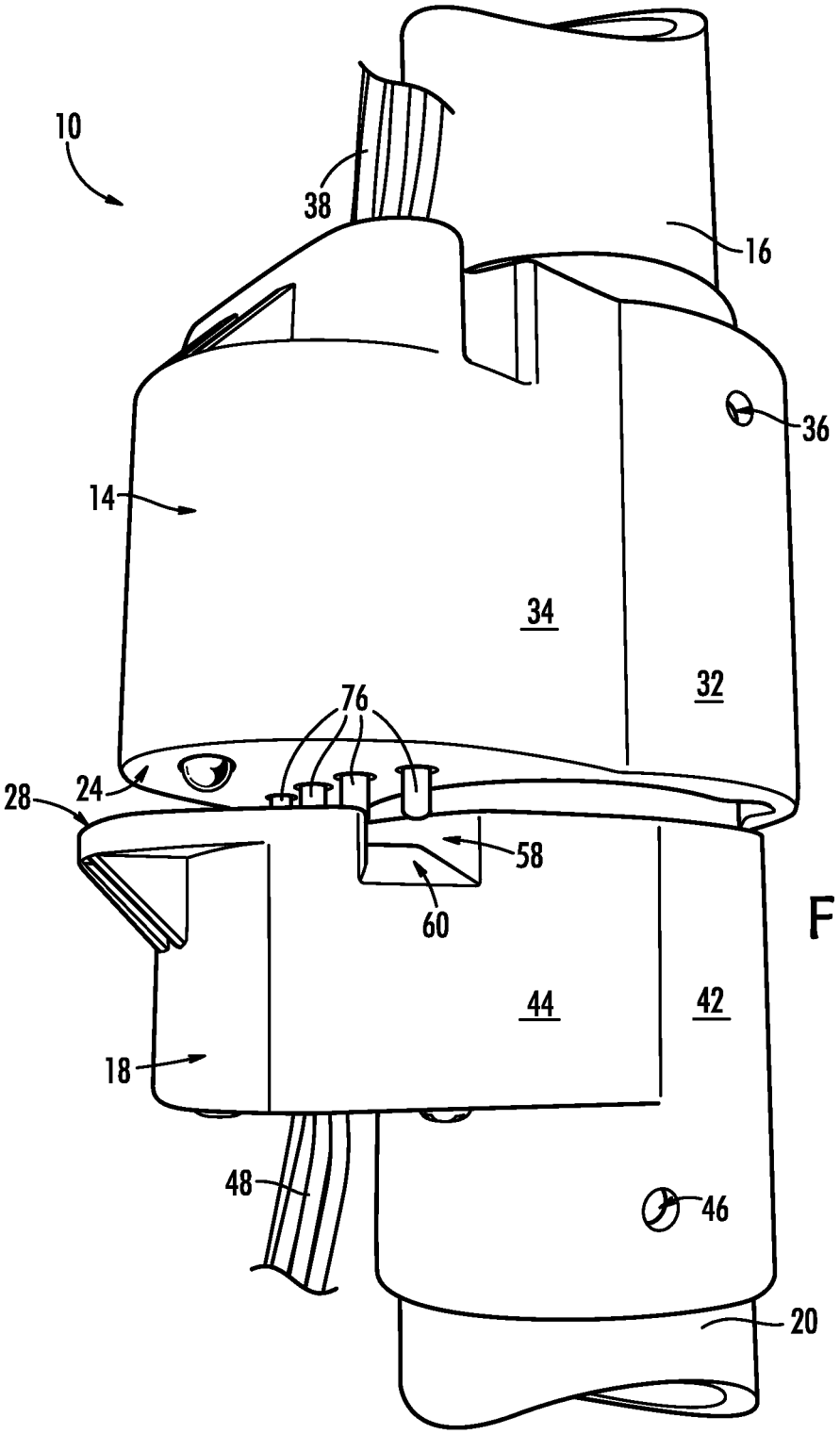
FIG. 4 is a left side perspective view of the upper and lower parts slightly rotated with respect to each other so they start to separate, according to an aspect of the disclosure.
Figure 5:
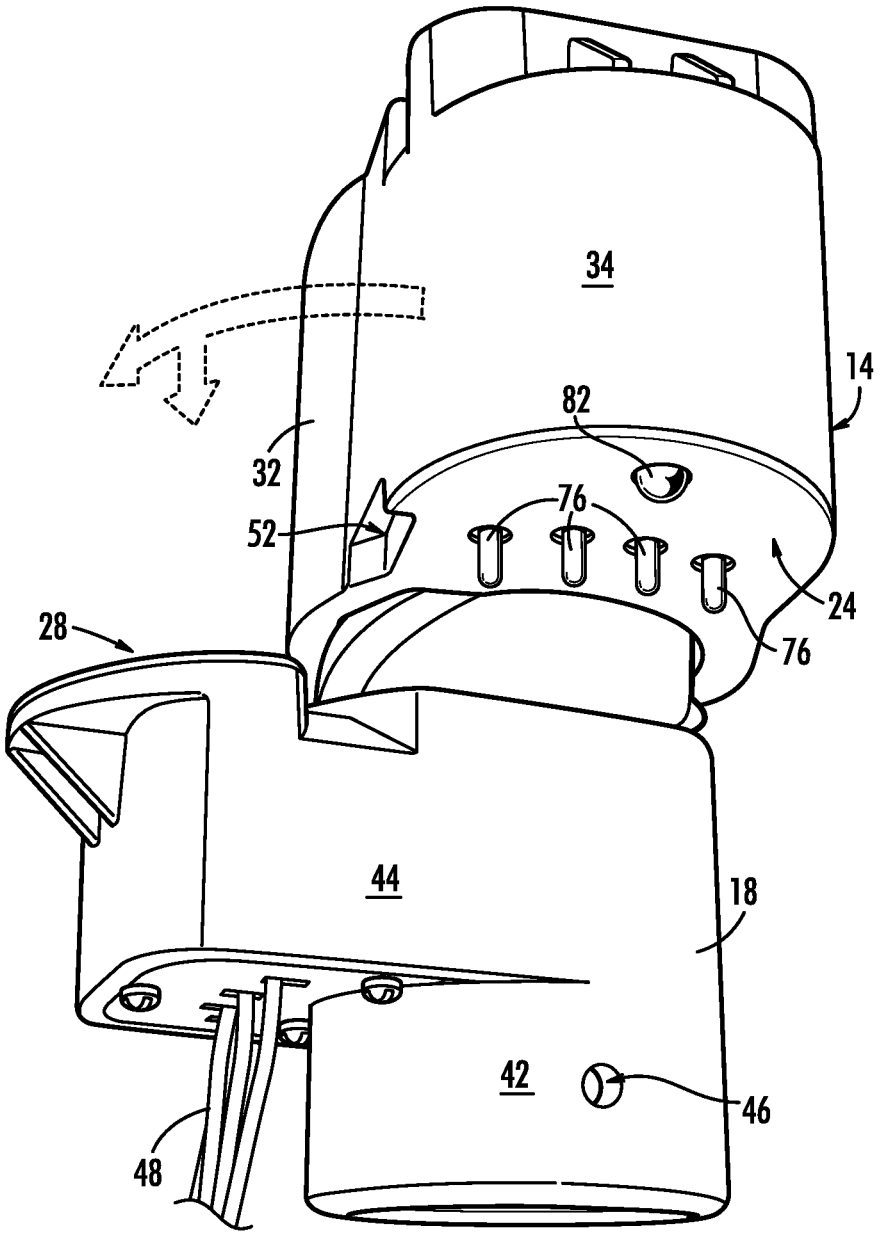
FIG. 5 is a left side perspective view of the upper and lower parts rotated further as they continue to separate with respect to each other, according to an aspect of the disclosure.
Figure 6:
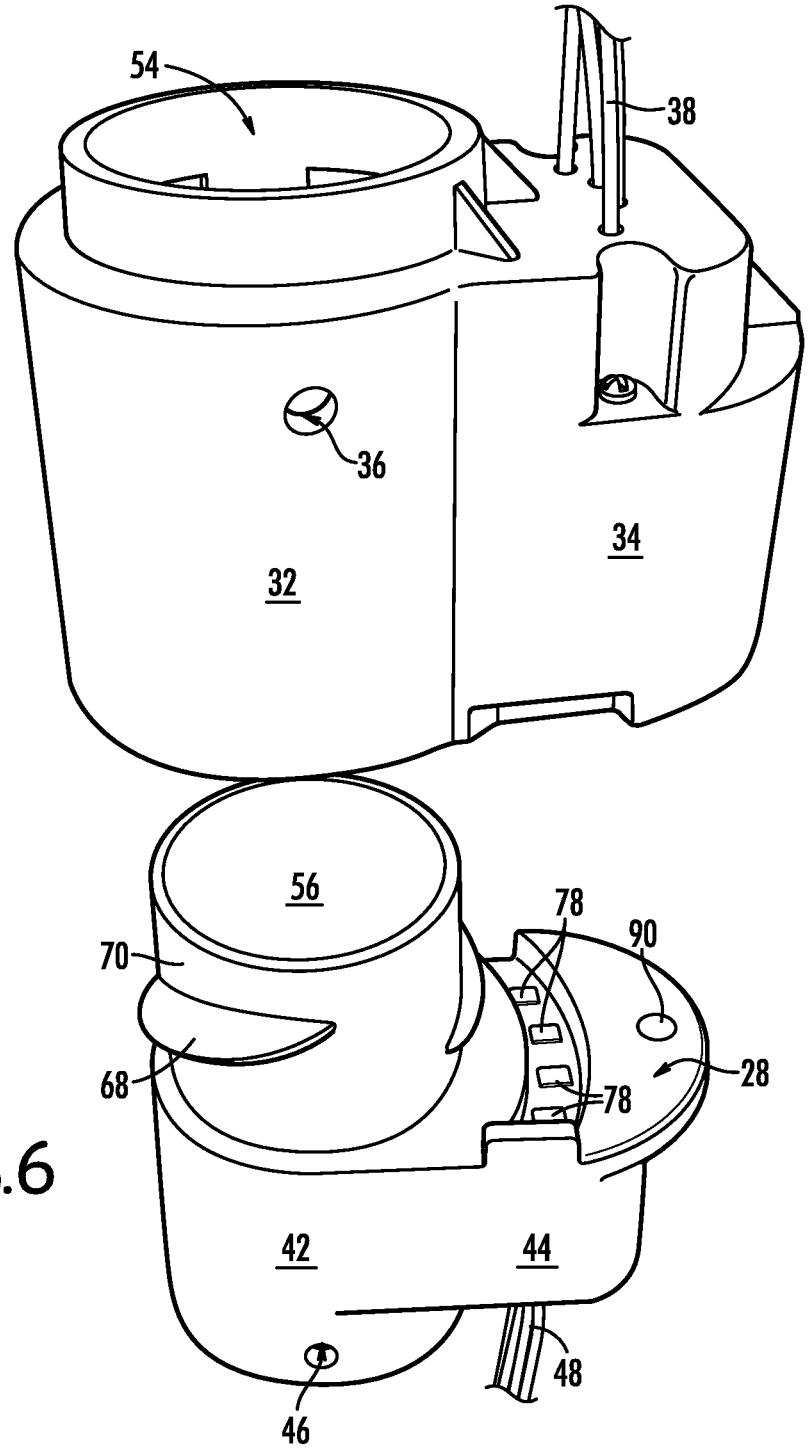
FIG. 6 is a right side, upper perspective view of the upper and lower parts rotated with respect to each other sufficiently to have separated, according to an aspect of the disclosure.
Figure 7:
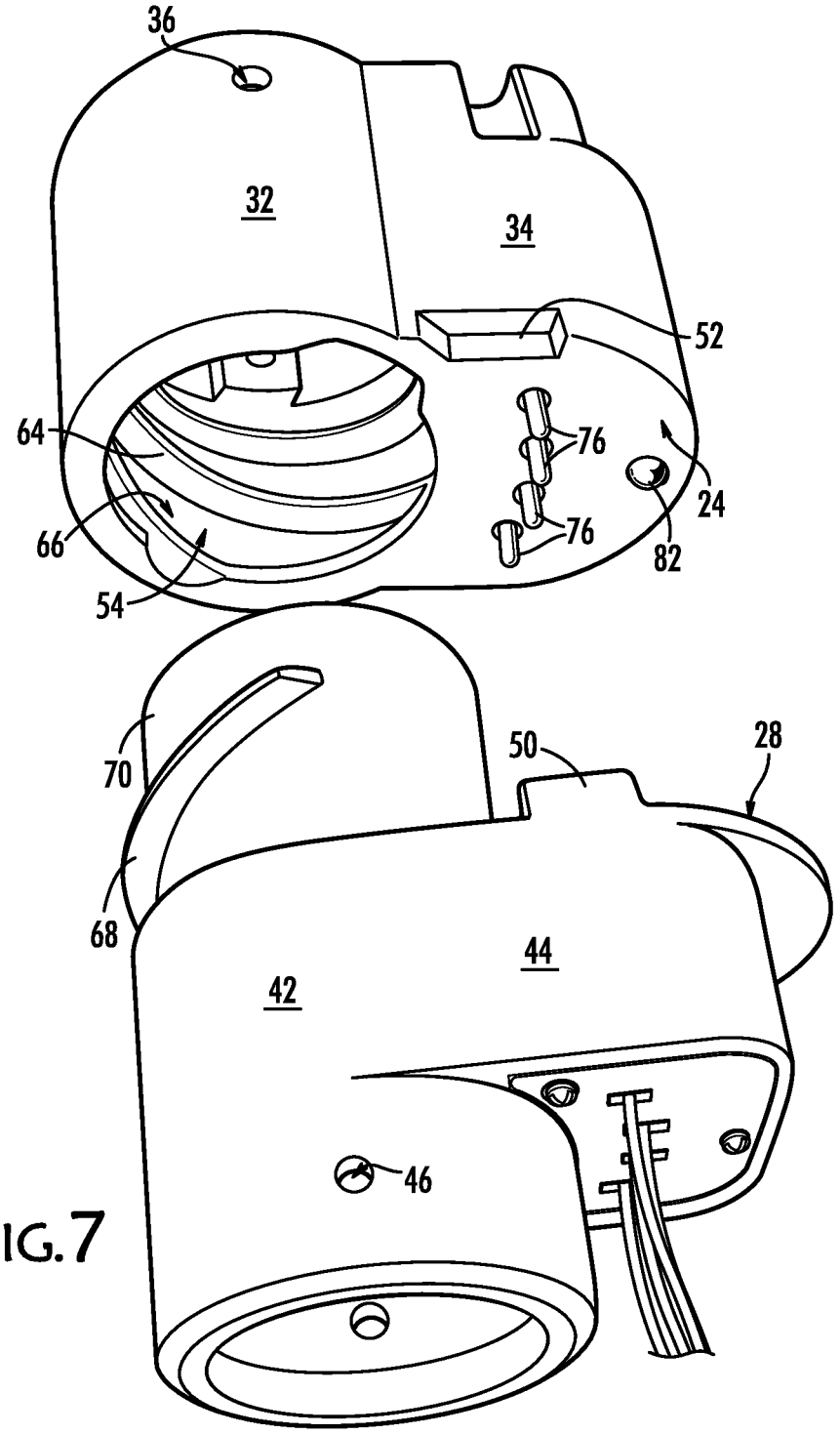
FIG. 7 is a right side, lower perspective of the upper and lower parts rotated with respect to each other sufficiently to have separated, according to an aspect of the disclosure.
Figure 8:
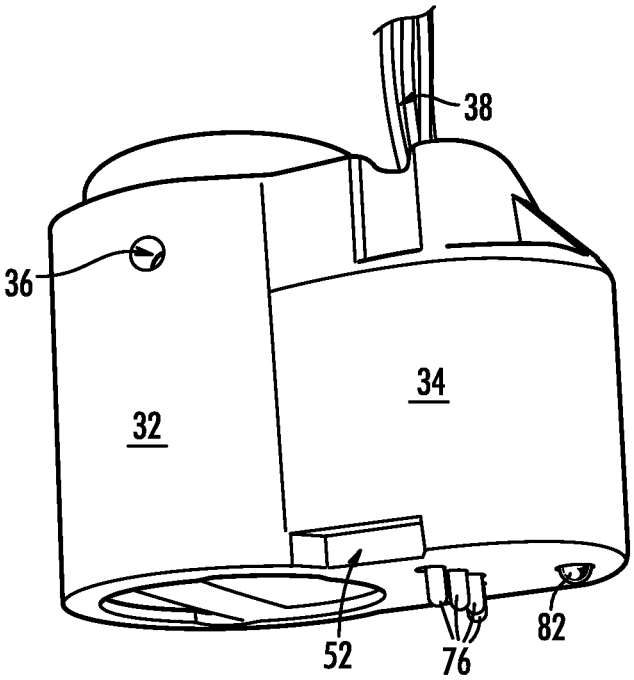
FIG. 8 is a right side, perspective of the upper and lower parts rotated with respect to each other sufficiently to have separated, according to an aspect of the disclosure.
Figure 8:
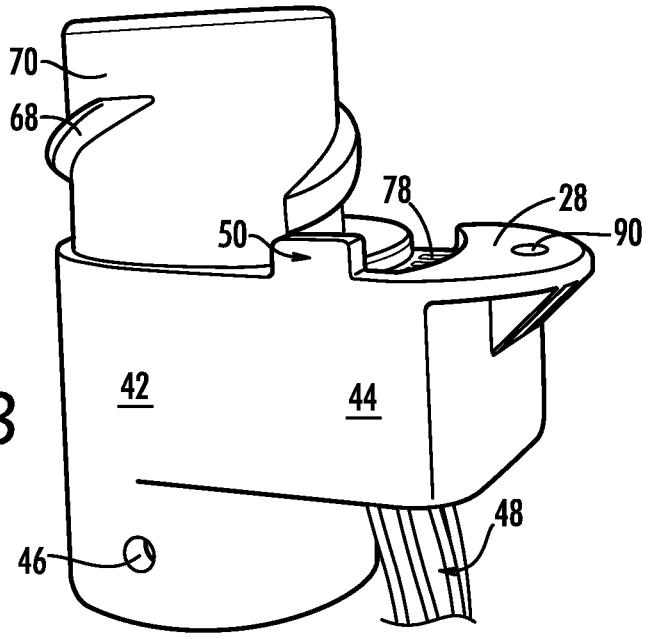

FIG. 3 illustrates upper and lower parts 14, 18 joined together. FIGS. 4 and 5 show upper part 14 after having been rotated in two increments from its joined position with respect to lower part 18 which is enough to separate upper and lower parts 14, 18. The separated upper and lower parts 14, 18, are seen in FIGS. 6-8.

As upper part 14 is rotated, threads 64 on the interior wall 66 of upper part 14 ride upwards on threads 68 on the exterior wall 70 of lower part 18, best seen in FIGS. 6-9. As upper part 14 rotates and lifts off lower part 18, contact pins 76 carried by upper part 14 separate from electrical contacts 78 (best seen in FIGS. 5 and 7) which are located on top 28 of lower part 18. It is through contact pins 76 and electrical contacts 78 that electrical current passes from upper part 14 to lower part 18. Contact pins 76 are urged downward from their recesses 84 formed in bottom 24 of upper part 14 by springs 80 above pins 76 in recesses 84, as seen in FIG. 5. Also, as seen by comparing FIGS. 5-7, to start rotation of upper part 14, a ball detent pin 82, seated in a spherical recess 84 formed in top 28 of lower part 18 may be pushed up and out of spherical recess 84 as it engages the side of recess 84 and is forced upwards against the urging another compression spring 86 seated in a recess 90 in bottom 24 of upper part 14. Ball detent pin 82 helps to assure the user that upper part 14 and lower part 18, and contact pins 76 and electrical contacts 78, are aligned and in registration with each other as soon as ball detent pin 82 seats in spherical recess 90. That alignment is maintained until upper part 14 and lower part 18 are rotated by the user with enough force to push ball detent pin 82 against its compression spring 86 to be moved out of spherical recess 84.

Figure 9:
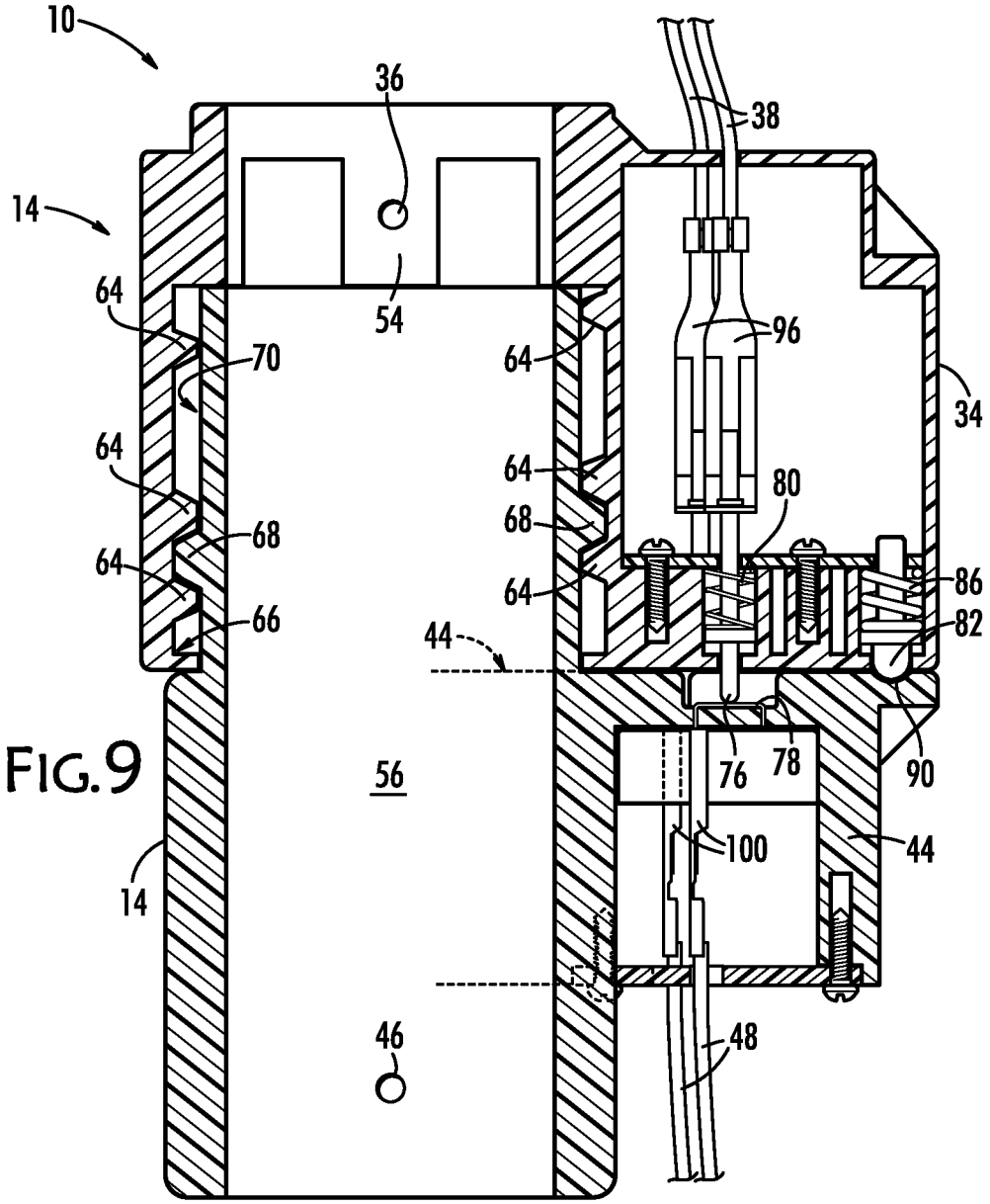
FIG. 9 is a right side cross sectional view of the joined upper and lower parts, according to an aspect of the invention.
Figure 10:
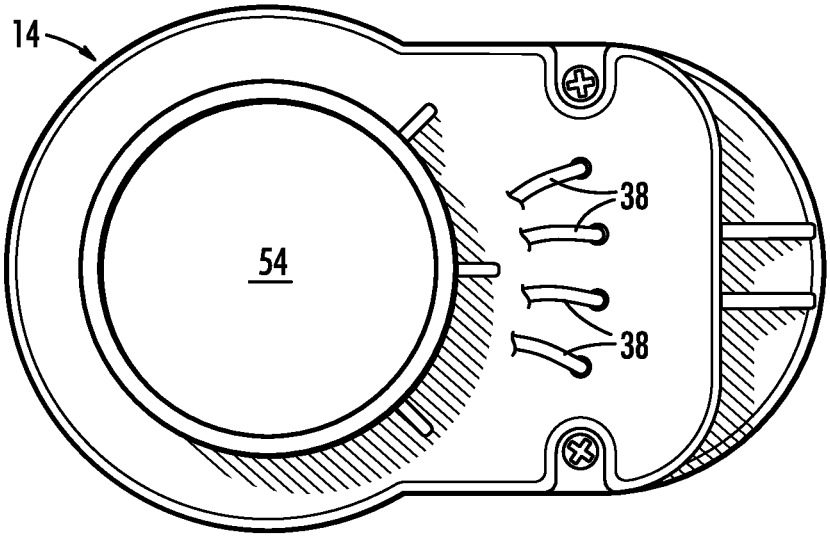
FIG. 10 is a top view of the upper part, according to an aspect of the disclosure.

When upper part 14 is rotated into the joined position with lower part (see arrows in FIG. 5), contact pins 76 will engage ramp 60 which acts as a cam surface, pushing them up against compression springs 80 (best seen in FIG. 9). When, after sufficient rotation of upper part 14 with respect to lower part 18 joins upper and lower parts 14, 18, detent pin 82 seats in recess 90, contact pins 76 will be in registration with electrical contacts 78.

FIG. 9 shows that electrical wires 38 in electrical side 34 of upper part 14 and electrical wires 48 in electrical side 44 of lower part 18 both terminate in terminals 96, 100, respectively, that connect to each other when contact pins 76 and electrical contacts 78 are in registration and in contact, that is, when upper part 14 and lower part 18 are in the joined position.

Referring now to FIGS. 3-8, upper part 14 and lower part 18 are shown initially joined and then separated. Separation is accomplished by twisting upper part 14 with respect to lower part 18 about an axis running through upper tube section 16 and lower tube section 20. Joining upper part 14 to lower part 18 then requires placement of the bottom 24 of upper part 12 onto the top 28 of lower part 18 at an angle with respect to upper part 14, and rotating upper part 14 to bring upper part 14 and lower part 18 into engagement and alignment.

The weight of upper tube section 16 and upper part 14 bears on internal threads 64 in the interior of wall 66 of upper part 14 to facilitate that rotation and connection. Upper and lower parts 14, 18, are placed in a starting position with internal threads 64 of upper part 14 on external threads 22 on lower part 14. The internal threads 20 of upper part 12 slide down exterior threads 68 as the weight of upper part 14 causes upper part 14 to rotate. As upper part 14 rotates into full alignment with lower part 18 at zero degrees, its four, spring-loaded electrical contact pins 76 encounter a ramp 60 on lower part 18. At about the same time, a spring-loaded ball detent pin 82 touches the top 28 of lower part 18. Further rotation of upper part 14 with respect to lower part 18, causes the four electrical contact pins 76 ride ramp 60 upwards, loading their internal springs 80 as they receded into upper part 14 (see FIGS. 4, 5, 7, and 9), and incidentally having the ends of electrical contact pins 76 cleaned by the friction of ramp 60. As the gap between upper and lower parts 14, 18, closes, further loading electrical contact pins 76 and detent pin 82 against its spring 86 occurs. On arriving at registration of upper part 12 and lower part 14 and pins 76 and electrical contacts 78, detent pin 82, being urged downward by its spring 86, seats in a recess 84 on top 24 of lower part 18 just as each electrical contact pin 76 finds its particular one of four electrical contacts 78. Further movement of upper part 12 with respect to lower part 14 is prohibited by a stop 50 on lower part 18 and rearward movement is resisted by ball detent pin 82 in recess 84. In this position, full electrical contact is made between upper and lower parts 14, 18, and spring-loaded electrical contact pins 76 remain firmly in electrical contact with electrical contacts 78 despite movement of the tree, its tree branches, and higher tube sections.

To unlock upper and lower parts 12, 14, upper part 12 is rotated in a clockwise direction with respect to lower part 14. Detent pin 18 is guided out of recess 46 allowing electrical contact pins 26 move out of registration with electrical contacts 50. Internal threads 20 of upper part 12 ride upward on external threads 22 of lower part 16 until upper and lower parts are at 180 degree angle with respect to each other, at which point they separate easily.

Electrical contact pins 26 on the upper part 12 are spring loaded so, as they compress against electrical contacts 50, the spherical bearing surfaces of each contact pin 25 is engaged. When upper part 16 moves while being coupled to lower part 14, this rotational movement causes electrical contact pins 26 to scrape across interface surface 44, cleaning contact pins 26 as internal springs 40 assure a good electrical conduction of all both pins 26 and electrical contacts 50.

Figure 11:
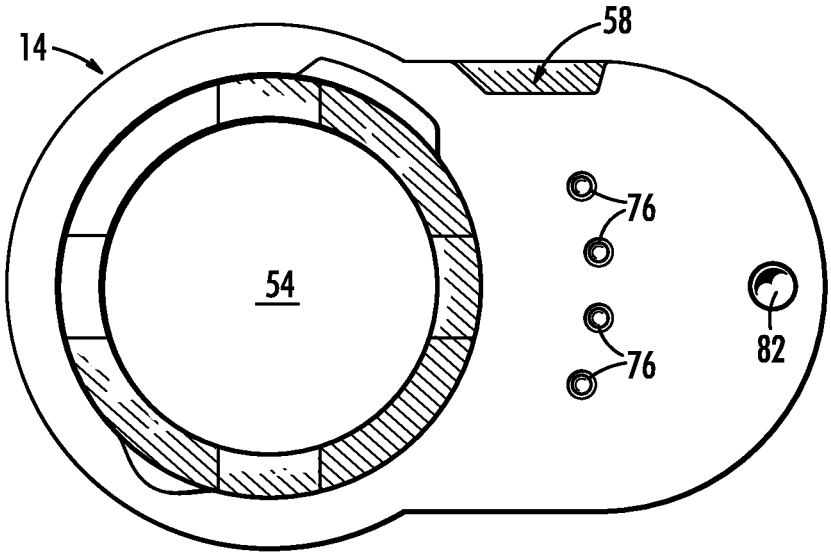
FIG. 11 is a bottom view of upper part, according to an aspect of the disclosure.
Figure 12:
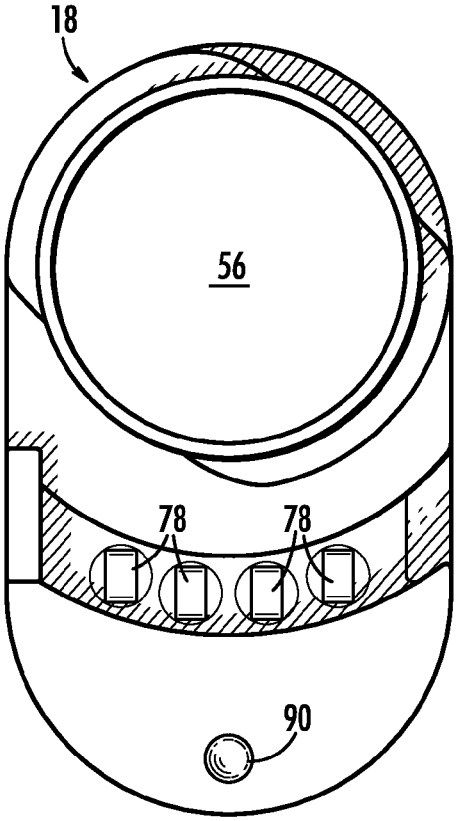
FIG. 12 is a top view of the lower part, according to an aspect of the disclosure.
Figure 13:
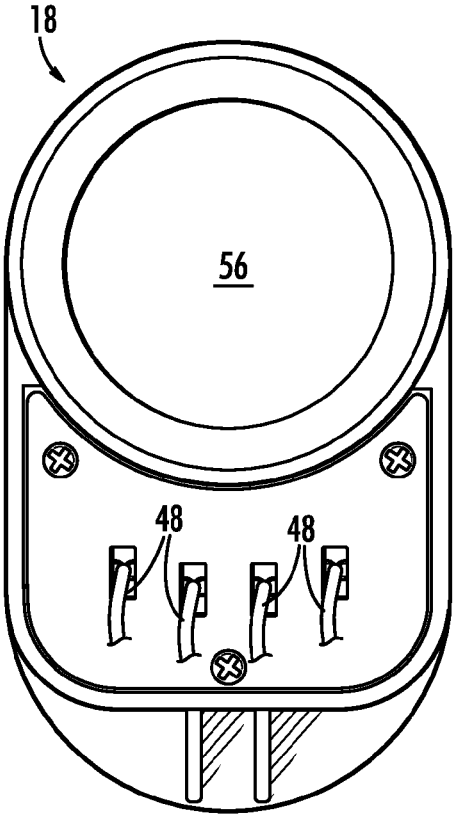
FIG. 13 is a bottom view of the lower part, according to an aspect of the disclosure.

In FIGS. 11 and 13, four wires 38, 48, are shown entering upper part 12 and exiting lower part 14, respectively, and four electrical contact pins 26 are in contact with four electrical contacts when upper part 12 and lower part 14 are in full registration. In the present embodiment, these four wires define three separate circuits, and one common ground for a total of four pairs of contacts. Other numbers of contacts are possible with only slight modification of the present embodiment.

Each tree will have two or three of tube sections 116, 120, depending on how tall the tree is. For example, a tree stand holds the lowermost tube section; then a first upper tube section, and then a next upper section, with an uppermost tube section after that. Taller trees may have two center tube sections. All trees will have a small, top crown section which may hold a decoration. Each tube section will have an upper part 14 attached at one end and a lower part 18 attached at the other end.

When upper part 14 and lower part 18 of connector 10 are coupled, electrical power may flow from lower part 18 through wires 48 and into upper part 14 via wires 38. Wires 38, 48 then run outside tube sections 16, 20, between upper part 14 and the next lower part 18 above it. Accordingly, wires 38, 48, do not run inside tube sections 16, 20, thereby avoiding significant assembly time and labor. Wires 38 end in terminals 96 and wires 48 end in terminals 100, as best seen in FIG. 9. Wires 38, 48, are easier to test and fix so higher quality is possible with much less effort. Wires 38, 48 and their terminals 96, 100, all are identical in appearance and function. Each tube section 16, 20, is attached at each end to an upper part 14 and a lower part 18, respectively, so each section of tree is identical and interchangeable. In the unlikely event that a tube section 16, 20, or an upper part 14 or lower part 18 becomes damaged, it can be replaced easily. There is no matching of wires by colors or different connectors to figure out, and no assortment of different sizes of wires to select the right wire from. So, in the unlikely event that an entire limb needs to be replaced, the consumer merely disconnects the affected limb from its corresponding upper or lower part 14, 18. A replacement limb can be shipped overnight to a consumer, reconnected to the upper or lower part, 12, 14, and its wires 38, 48 plugged back in. This feature makes dealing with fault issues in connection with the tree lighting much quicker and easier, and provides an aftermarket for replacement limbs when they break or fail, without having to buy a new tree, and thereby extending the usable life of the tree well beyond others on the market.

Electrical contact pins 76 and electrical contacts 78 are self-cleaning brass, nickel plated, or high-nickel stainless steel. Electrical contact pins 76 extend from bottom 24 of upper part 14 and are vertically moveable against individual compression springs 80 that may have a travel distance of about 2 mm to 4 mm to compensate for tolerances during assembly. The length of these spring-loaded, moving contact pins 76 is selected so that they can retract into upper part 14 so that their ends are flush with bottom 24 but extend a few millimeters when upper part 14 is separated from lower part 18, just enough to engage ramp 60 as upper part 14 is rotated into engagement with lower part 18. When upper part 14 has been rotated with respect to lower part 18 just far enough so that contact pins 76 are in registration with their respective electrical contacts 78, upper part 14 and lower part 18 will automatically lock in that position.

The automatic locking aspect, which include ball detent pin 82, recess 84, and compression spring 86 are aided by stop 50 and both internal threads 64 and external threads 68 that bring bottom 24 of upper parts 14 into engagement with top 28 of lower part 18. Upper and lower parts 14, 18, are held in position when ball detent pin 82 enters recess 84 and is held there by compression spring 86. The spring force provided by spring 86 against movement should correspond to the largest tree with which it is used to that merely picking up the tree does not cause ball detent pin 82 to slip out of recess 84.

Another aspect of connector 10 is the ability of connector 10 to assist the consumer during assembly and disassembly by using dual, multi-shaped, spherical and spiral bearing surfaces, in which male spherical, spiral, bearing surfaces act as a torque amplifier, making lowering and lifting of upper part 14 easier so that when the consumer unlocks upper part 14, perhaps merely pushing a limb counter-clockwise, the connection of threads 64, 68 easily breaks so upper part 14 can be lifted up and out of lower part 18 without prying or pulling. And, while separating upper and lower parts 14, 18, the electrical circuits are automatically disconnected, making disassembly faster and easier.

Another aspect of the disclosure is the shapes of the internal and external threads, 64, 68, as best seen in FIGS. 7-9. These two threads engage in a way that they act as a helical cam lowering/lifting mechanism. This mechanism comprises two planes; one triangular, and the other trapezoidal, distributed 180 degrees apart as an inclined plane, separated by a helical arbor filled by the tube. This arbor generates a substantial lowering or lifting force upon a rotation of at least 45 degrees depending on the application but which allows for an easy separation or coupling, although various thread pitches are also possible. The differently shaped threads prevent cross-threading so proper alignment during assembly is always assured without having to use a keyway or the like.

The sample shown in the figures is a 180 degree model which means the lifting and lowering takes place during a 180 degree rotation of the section being mounted or removed. Other degrees of rotation are possible by changing the pitch of the threads. A steeper pitch reduces the angle upper part 14 must be rotated but reduces the security of the two parts holding together in normal use; a more gradual pitch increases the angle through which upper part 14 must be rotated with respect to lower part 18 but increases that security. Connector 10 is designed to easily couple by placing the bottom end of upper part 14 over the threaded section of lower part 18, then, by easily rotation upper part 14, the two parts couple to each other without effort, the parts 14, 18, taking the load off of person assembling them. Then simply by twisting upper part 14 clockwise, the connector automatically aligns to lower part 18, and at the same time making all of the electrical connections as the two parts 14, 18, engage fully with an audible confirming click.

Those skilled in the art of artificial trees will appreciate that many modifications and substitutions may be made to the embodiments described above without departing from the spirit and scope of the disclosure.

What is claimed is:

1. A connector for connecting sections of and supplying power to a lighted artificial holiday tree, said tree being made of sections joined together, each section having an upper end and an opposing lower end, said connector comprising:

(a) an upper part having a passage formed there through and a wiring chamber, said wiring chamber being electrically isolated from said passage, a lower end of a first section being insertable into said passage and securable to said upper part, said wiring chamber having at least one electrical contact; and (b) a lower part having a passage formed there through and a wiring chamber, said wiring chamber of said lower part being electrically isolated from said passage of said lower part, and an upper end of a second section being insertable into said passage of said lower part and securable to said lower part, said wiring chamber of said lower part having at least one electrical contact, and wherein said upper part and said lower part are threadably joinable and separable by rotating said upper part with respect to said lower part between a joined position and a separated position, and wherein said when said upper part and said lower part are joined, said at least one contact of said upper part and said at least one contact of said lower part are in electrical contact with each other and wherein when said upper part and said lower part are rotated from said joined configuration, said at least one electrical contact is broken.

2. The connector of claim 1, wherein said passage of said upper part is defined by an interior wall, said interior wall carrying interior threads, and wherein lower part includes an exterior wall carrying exterior threads, and wherein when said upper part and said lower part are joined, said threads on said exterior wall of said lower part thread to said threads of the interior wall of said upper part.

3. The connector of claim 2, wherein said interior threads have a triangular cross section and said exterior threads are trapezoidal.

4. The connector of claim 1, wherein said at least one electrical contact of said upper part is pin and said pin is movable with respect to a spring, and wherein when said upper part is rotated with respect to said lower part, said lower part compresses said spring so that said pin is urged by said spring into electrical contact with said electrical contact of said lower part.

5. The connector of claim 1, wherein said upper part further comprises at least one wire, said wire of said at least one wire carrying a terminal electrically connected to said electrical contact of said upper part.

6. The couple of claim 5, wherein said upper part further comprises a wiring harness to manage said at least one wire.

7. The connector of claim 1, wherein said lower part further comprises at least one wire, said wire of said at least one wire carrying a terminal electrically connected to said electrical contact of said lower part.

8. The connector of claim 7, wherein said lower part further comprises a wiring harness to manage said at least one wire.

9. The connector of claim 1, wherein said lower part has an interface surface wherein, when as said upper part and said lower part are rotated to said joined position from said separated position, said interface surface of said lower part closes to said upper part.

10. The connector of claim 9, wherein said interface surface carries locking flange preventing over-rotation of said upper part with respect to said lower part.

11. The connector of claim 9, wherein said interface surface of said lower part carries a recess and wherein said upper part carries a ball detent, and wherein when said upper part has been rotated to said joined position, said ball detent seats in said recess.

12. The connector of claim 9, wherein said interface surface of said lower part carries a ramp, and wherein said at least one electrical contact said upper part is a spring loadable pin, rotation of said upper part with respect moves said pin up said ramp thereby loading said pin before said upper part reaches said joined position with respect to said lower part.

* * * * *